US008556193B2

(12) United States Patent
Anuskiewicz

(10) Patent No.: US 8,556,193 B2
(45) Date of Patent: Oct. 15, 2013

(54) IRRIGATION SPRINKLER WITH CAPTIVE NOZZLE RETENTION SCREW

(75) Inventor: Ronald H. Anuskiewicz, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 800 days.

(21) Appl. No.: 12/511,421

(22) Filed: Jul. 29, 2009

(65) Prior Publication Data

US 2011/0024522 A1 Feb. 3, 2011

(51) Int. Cl.
*B05B 15/10* (2006.01)

(52) U.S. Cl.
USPC ..... 239/204; 239/240

(58) Field of Classification Search
USPC ..... 239/240, 201–210; 470/10
See application file for complete search history.

(56) References Cited

U.S. PATENT DOCUMENTS 5,697,929 A * 12/1997 Mellinger ..... 606/270
5,762,270 A * 6/1998 Kearby et al. ..... 239/205
5,842,923 A * 12/1998 Umemura et al. ..... 470/10
6,871,795 B2 * 3/2005 Anuskiewicz ..... 239/74
7,287,711 B2 10/2007 Crooks ..... 239/240

* cited by examiner

*Primary Examiner* — Len Tran
*Assistant Examiner* — Joel Zhou
(74) *Attorney, Agent, or Firm* — Knobbe, Martens, Olson & Bear LLP

(57) ABSTRACT

A nozzle turret for an irrigation sprinkler includes a body having a rotational axis and a nozzle socket extending transverse to the rotational axis. A nozzle is removably received in the socket. A sleeve in the body opens on a top side of the body and defines a bore that communicates with the socket. A nozzle retention screw with a shank having a lower male threaded segment is screwed into the bore of the sleeve from the top side of the body. The shank extends into the socket a sufficient depth to retain the nozzle in the socket. The screw has a head that abuts an upper end of the sleeve when the screw is fully screwed in a downward direction into the sleeve. The screw shank has an upper unthreaded segment with a predetermined longitudinal dimension selected relative to a longitudinal dimension of the bore to enable the screw to be unscrewed in an upward direction from the sleeve despite stripping of a segment of a female threaded portion of the bore.

18 Claims, 6 Drawing Sheets

IRRIGATION SPRINKLER WITH CAPTIVE NOZZLE RETENTION SCREW

FIELD OF THE INVENTION

The present invention relates to irrigation sprinklers for watering turf and landscaping.

BACKGROUND

Many parts of the world lack sufficient rainfall at different times of the year to maintain the health of turf and landscaping. Irrigation systems are therefore used to deliver water to such vegetation from municipal water supplies and wells according to a watering schedule. A typical irrigation system comprises a programmable controller that turns valves ON and OFF to deliver water through a plurality of sprinklers connected to the valves via subterranean pipes. These sprinklers are usually rotor-type, impact, spray or rotary-stream sprinklers. A typical rotor-type sprinkler has a removable nozzle that is held in place by a nozzle retention screw that can also serve as a stream interrupter to adjust the radius of the sprinkler.

SUMMARY OF THE INVENTION

In accordance with the present invention a nozzle turret for an irrigation sprinkler includes a body having a rotational axis and a nozzle socket extending transverse to the rotational axis. A nozzle is removably received in the socket. A sleeve in the body opens on a top side of the body and defines a bore that communicates with the socket. A nozzle retention screw with a shank having a lower male threaded segment is screwed into the bore of the sleeve from the top side of the body. The shank extends into the socket a sufficient depth to retain the nozzle in the socket. The screw has a head that abuts an upper end of the sleeve when the screw is fully screwed in a downward direction into the sleeve. The screw shank has an upper unthreaded segment with a predetermined longitudinal dimension selected relative to a longitudinal dimension of the bore to enable the screw to be unscrewed in an upward direction from the sleeve despite stripping of a segment of a female threaded portion of the bore.

DETAILED DESCRIPTION

Figure 1A:
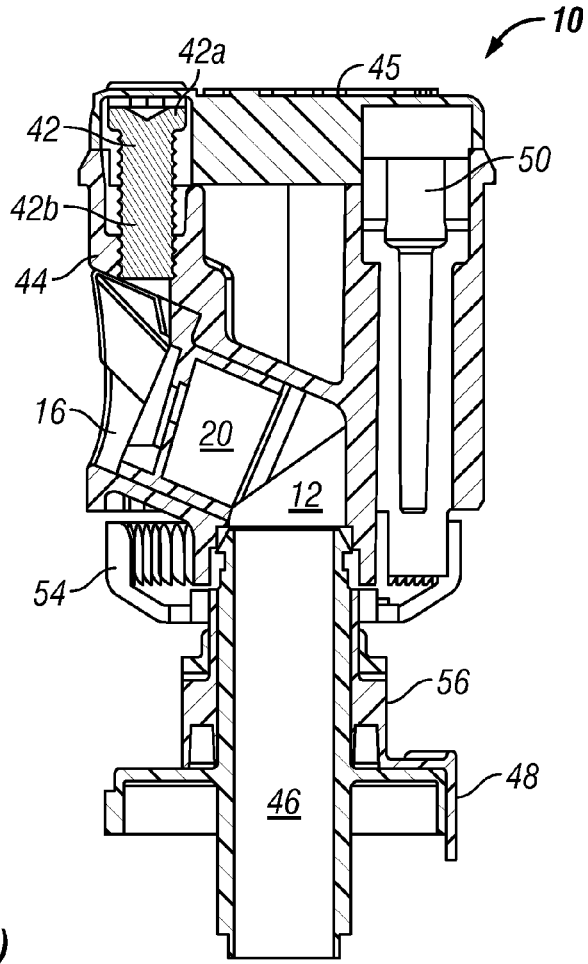
FIG. 1A (Prior Art)
FIG. 1A is an enlarged vertical sectional view of a nozzle turret of a first prior art rotor-type sprinkler.

FIG. 1A illustrates the cylindrical head or turret 10 of a conventional rotor-type sprinkler of the type disclosed in U.S. Pat. No. 6,871,795 granted Mar. 29, 2005, entitled IRRIGATION SPRINKLER WITH EASY REMOVAL NOZZLE, and assigned to Hunter Industries, Inc., the entire disclosure of which is hereby incorporated by reference. The turret 10 has a dog-legged water outlet passage 12 that accommodates a removable nozzle 20 that is inserted into a nozzle receiving socket 16. A stainless steel nozzle retention screw 42 is screwed into a female threaded sleeve portion 44 of the turret 10. The screw 42 has a head 42*a* and a shank 42*b* that is completely threaded along its entire length. The screw 42 can be turned by inserting a tool (not illustrated) into a slot in the head 42*a* so that the shank 42*b* extends into a U-shaped opening in the nozzle 20 to retain the nozzle 20 in the socket 16. The top side of the turret 10 has a cover 45 made of an elastomeric material. The cover 45 has a pair of slits (not illustrated) arranged in a criss-cross fashion and aligned over the head of the screw 42. One end of a tool such as that illustrated in FIG. 10 of U.S. Pat. No. 6,871,795 can be inserted through the slits to engage the head of the screw 42 for twisting the same.

Referring still to FIG. 1A, water passes through a hollow drive shaft 46 and through the nozzle 20 that has one or more orifices sized to deliver the desired rate of precipitation in terms of gallons per minute (GPM) at a nominal pressure, usually between about thirty and ninety pounds per square inch (PSI). The water is typically ejected from the nozzle 20 as an inclined stream of water (not illustrated). The screw 42 can be turned the vary the degree to which the shank 42*b* penetrates and obstructs the stream to thereby adjust the radius or range of the sprinkler in terms of how far the stream of water extends over the landscaped area.

Portions of the reversing mechanism of the rotor-type sprinkler associated with the turret 10 are also illustrated in FIG. 1A. These include an arc adjustment tab 48 that is carried by a cylindrical sleeve 56 and an arc adjustment shaft 50 with a geared lower end that engages a bull gear 54 that is rigidly mounted to the upper end of the cylindrical sleeve 56. Further details of an oscillating rotor-type sprinkler having a turret of this general type are disclosed in U.S. Pat. No. 7,287,711 granted Oct. 30, 2007, entitled ADJUSTABLE ARC ROTOR-TYPE SPRINKLER WITH SELECTABLE UNI-DIRECTIONAL FULL CIRCLE NOZZLE ROTATION, and assigned to Hunter Industries, Inc., the entire disclosure of which is hereby incorporated by reference.

While rotor-type sprinklers including the turret 10 illustrated in FIG. 1A have been successfully commercialized by Hunter Industries, Inc., the assignee of the subject application, there have been problems with the nozzle retention screw 42. More particularly, if the screw 42 is turned in a clockwise direction (viewed from above) the head 42*a* of the screw 42 will eventually engage the upper end of the sleeve portion 44. Continued turning of the screw in a clockwise manner will result in the threads in the sleeve portion 44 being completely stripped since the head 42*a* of the screw 42 engages the upper end of the sleeve portion 44 and prevents the screw from advancing any further downwardly. Once the female threads in the sleeve portion 44 have been stripped, it is no longer possible to back the screw 42 out of the sleeve portion 44 by turning the screw in a counter-clockwise direction to increase the radius of the sprinkler or replace the nozzle 20 with a different nozzle having a different GPM rating.

Figure 1B:
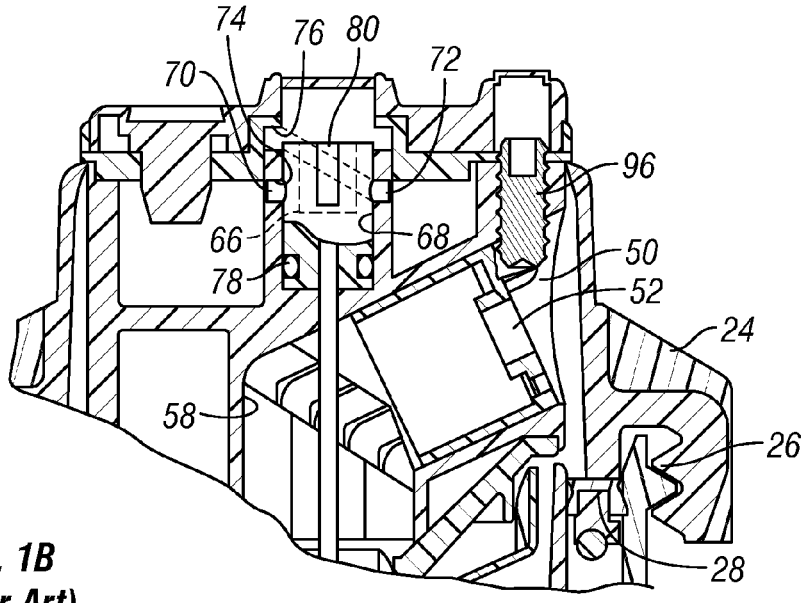
FIG. 1B (Prior Art)
FIG. 1B is an enlarged fragmentary view of a nozzle turret of a headless nozzle retention screw utilized in a second prior art rotor-type sprinkler.

If the turret 10 is provided with a headless nozzle retention screw 96 (FIG. 1B) so that the threads in the sleeve portion 44 will not be stripped, the user can accidentally drive the screw completely through the sleeve portion 44. If this is done when the water to the sprinkler is ON, both the screw and the nozzle 20 will be ejected from the turret 10 by the stream of water flowing through the drive shaft 46 and through the outlet passage 12. See U.S. Pat. No. 5,762,270 granted Jun. 9, 1998 and entitled SPRINKLER UNIT WITH FLOW STOP for further details of a rotor-type sprinkler that uses a nozzle retention screw without any head.

Figure 2:
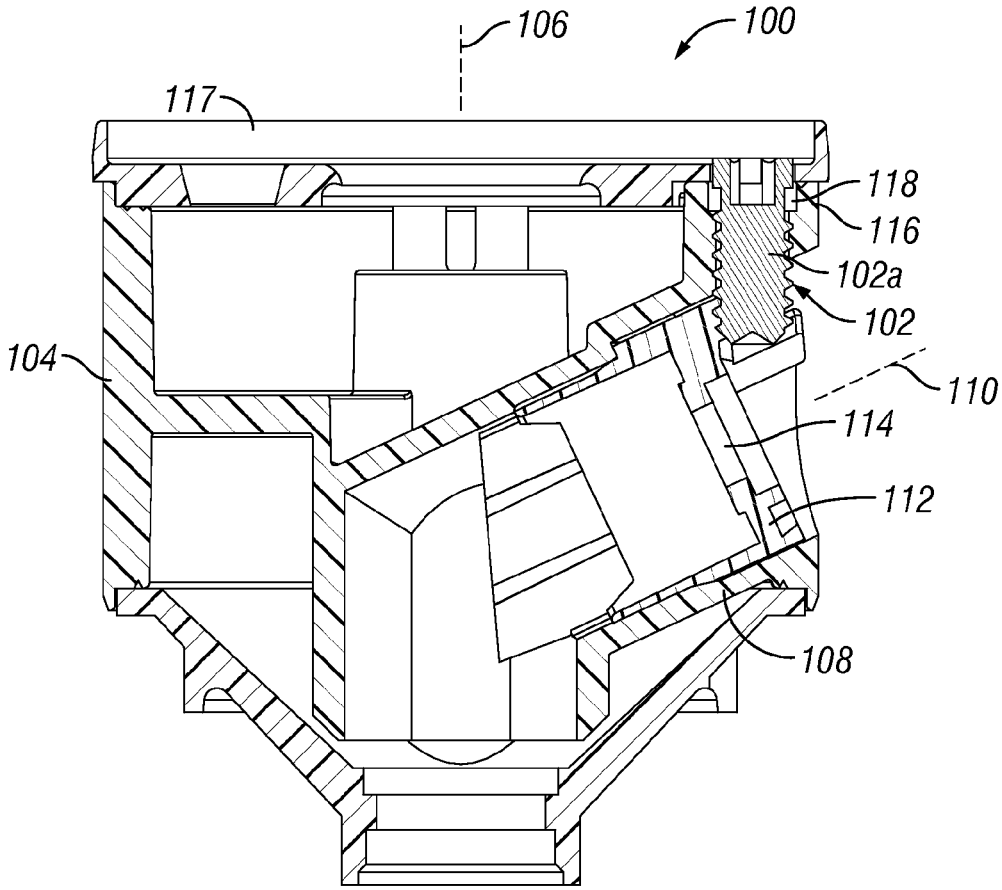
FIG. 2 is an enlarged vertical sectional view of a nozzle turret in accordance with an embodiment of the present invention.

FIG. 2 illustrates a nozzle turret 100 in accordance with an embodiment of the present invention that allows a novel nozzle retention screw 102 to be unscrewed despite over tightening of the screw 102. The nozzle turret 100 can be a component of an irrigation sprinkler of the type illustrated in the aforementioned U.S. Pat. No. 7,287,711. The nozzle turret 100 includes a generally cylindrical injection molded plastic body 104 having a vertical rotational axis 106 and formed with an inclined nozzle socket 108 having an insertion axis 110 that extends transverse to the rotational axis 106. An injection molded plastic nozzle 112 with a stepped orifice 114 is removably received in the socket 108. The body 104 is further formed with a vertically extending sleeve 116 that opens on a top side of the body 104 and defines a bore 118 that communicates with the socket 108.

Figure 3:
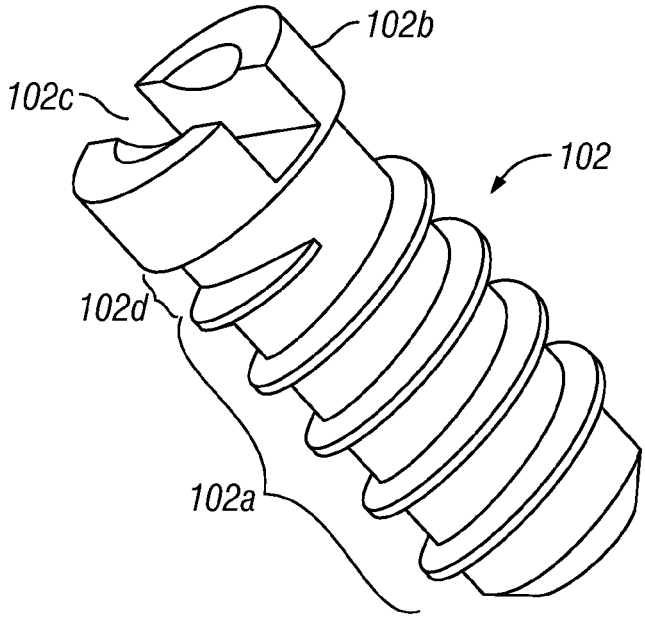
FIG. 3 is a greatly enlarged isometric view of the nozzle retention screw of the nozzle turret of FIG. 2.
Figure 7:
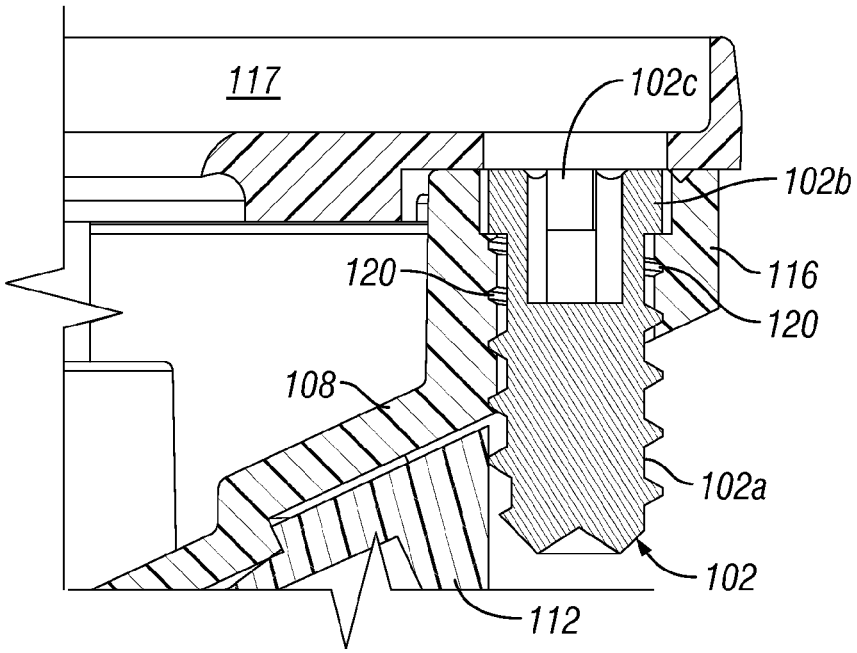

The nozzle retention screw 102 (FIG. 3) is preferably made of stainless steel and includes a shank having a lower male threaded segment 102*a* that is screwed into the bore 118 of the sleeve 116 from the top side of the body 104. An elastomeric circular cover (not illustrated) is mounted in a recess 117 (FIG. 2) formed in a top side of the body 104. The cover has a slits arranged in a cross-hair configuration above the head 102*b* (FIG. 3) of the screw 102. A screw driver, or hex key wrench, (not illustrated) can be inserted through the cross-hair slits into a slot 102*c* formed in the head 102*b* of the screw 102 so that the screw 102 can be manually screwed up and down in the sleeve 116. As seen in FIG. 2, the shank of the screw 102 extends into the sleeve 116 a sufficient depth to retain the nozzle 112 in the socket 108. The threaded segment 102*a* of the screw 102 extends through a U-shaped receptacle in the nozzle 112. As illustrated in FIG. 7, the head 102*b* of the screw abuts an upper end of the sleeve 116 when the screw 102 is fully screwed in a downward direction into the sleeve 116. The bore 118 (FIG. 4) in the sleeve 116 has an upper larger diameter segment 118*a* and a lower smaller diameter segment 118*b*. The upper end of the sleeve that is abutted by the head 102*b* of the screw 102 is a shoulder 118*c* defined by the junction of the upper larger diameter segment 118*a* and lower smaller diameter segment 118*b* of the bore 118. The screw shank has an upper unthreaded segment 102*d* (FIG. 3) with a predetermined longitudinal dimension selected relative to a minimum longitudinal dimension of the lower bore segment 118*b* in the sleeve 116 in order to enable the screw 102 to be unscrewed in an upward direction from the sleeve 116 despite stripping of a female threaded portion of the bore as described hereafter in detail.

Figure 4:
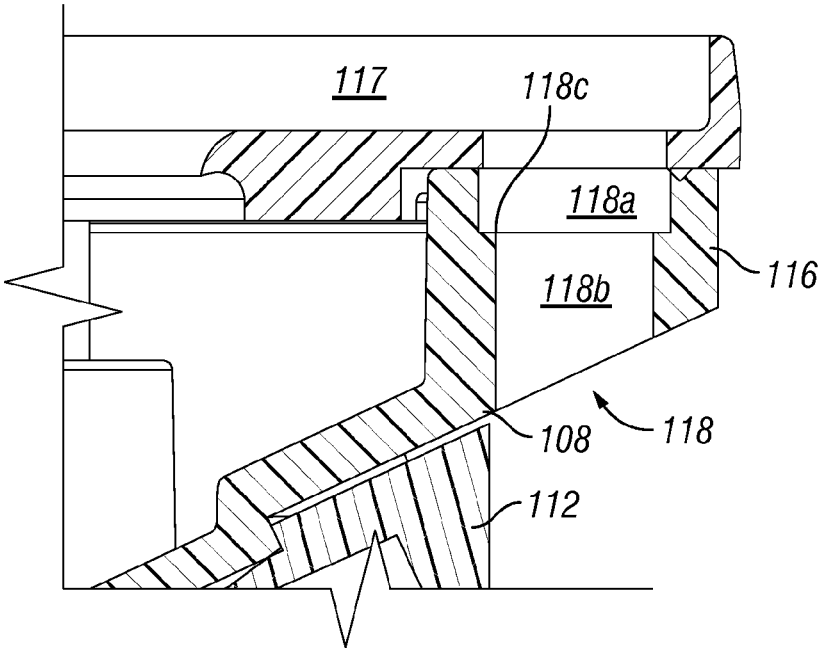
FIG. 4 is a greatly enlarged portion of FIG. 2 illustrating the original form of the sleeve in the nozzle turret before the nozzle retention screw is screwed into the same.

FIG. 4 illustrates the configuration of the sleeve 116 in the nozzle turret 100 before the screw 102 has been installed. The sleeve 116 initially is molded without any female threads because these threads are formed by the screw 102 when it is installed. The diameter of the upper segment 118*a* of the bore 118 in the sleeve 116 is sized to provide clearance for the screw head 102*b*.

Figure 5:
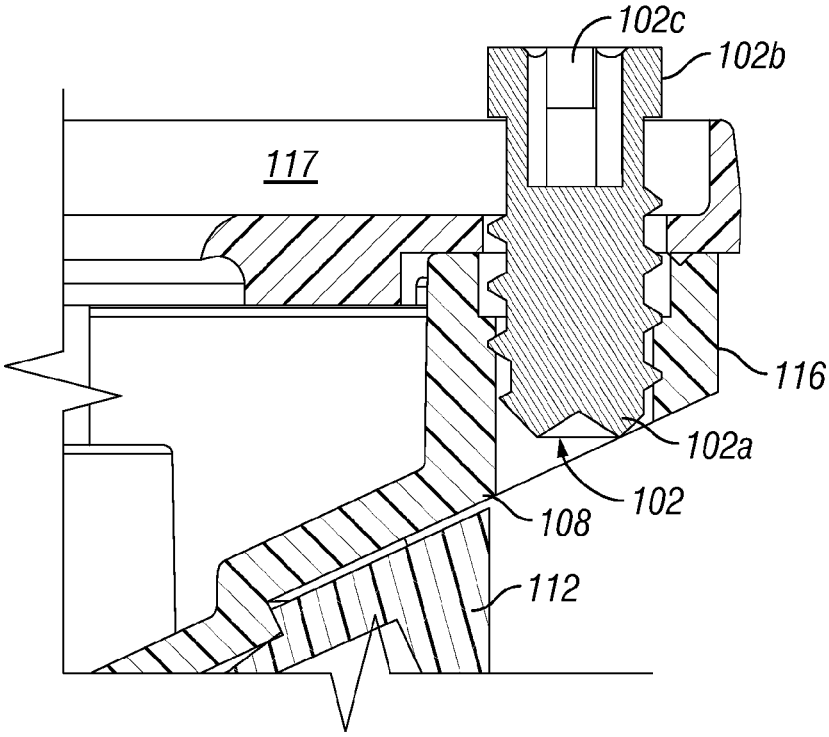
FIGS. 5-9 are a sequence of views similar to FIG. 4 illustrating different amounts of screwing of the nozzle retention screw into the sleeve of the turret.

FIG. 5 illustrates the screw 102 installed to a proper level in the sleeve 116 to allow the nozzle 112 to be installed or removed from the socket 108 along the insertion axis 110 (FIG. 2). The process of installing the screw 102 has formed female threads in the interior plastic wall of the lower smaller diameter segment 118*b* of the bore 118 in the sleeve 116.

Figure 6:
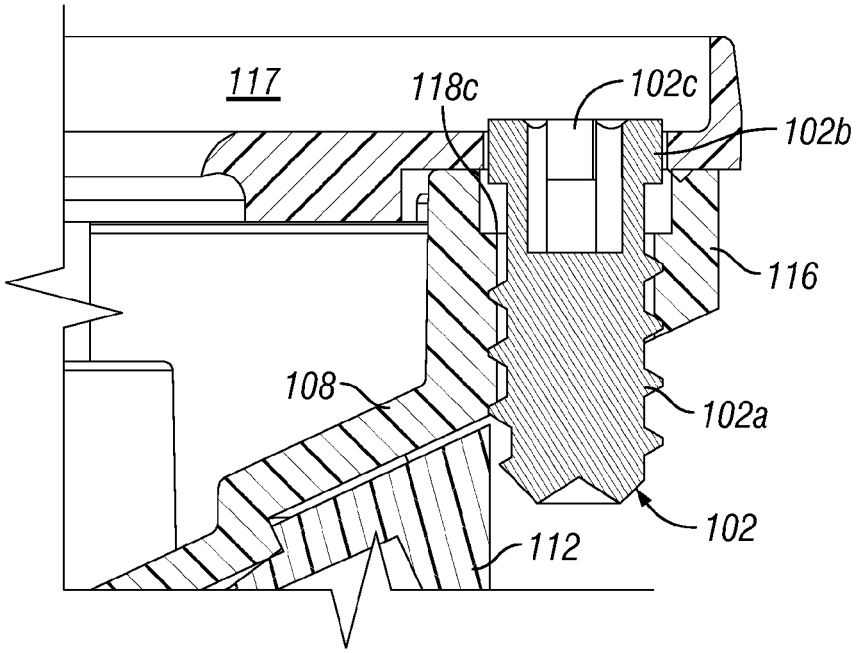

FIG. 6 illustrates the screw 102 installed to a proper level to retain the nozzle 112 in position FIG. 7 illustrates the screw 102 installed to its lowest level to retain the nozzle 112 in position and provide maximum interruption to a stream of water (not illustrated) emitted from the nozzle 112 to reduce the radius of wetted area. Female threads 120 formed in the wall of the segment 118*b* by the screw 102 are illustrated in the upper portion of the segment 118*b* adjacent the unthreaded segment 102*d* of the screw 102 where the diameter of the screw 102 is effectively reduced by the absence of male threads in this area.

Figure 8:
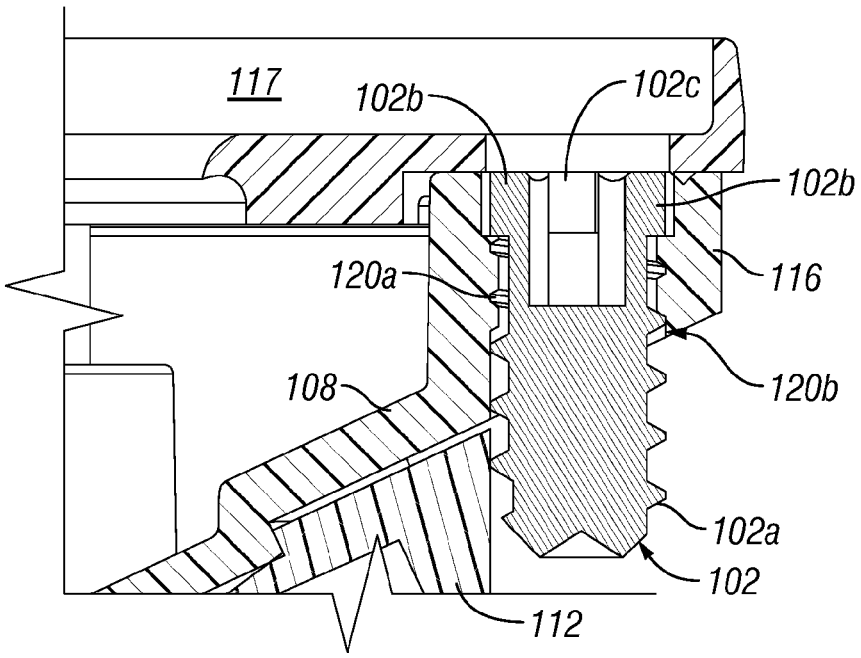

FIG. 8 also illustrates the screw 102 installed to its lowest level in the nozzle turret 100. This view further illustrates the effects on the wall of the segment 118*b* after the screw 102 has been over-tightened in the sleeve 116. The screw 102 still retains the nozzle 112 in position in the socket 108 and provides maximum interruption to the stream of water emitted from the nozzle 112. Continued tightening of the screw 102 by turning it in a clock-wise direction viewed from above the nozzle turret 100 does not result in the male threaded segment 102*a* of the screw 102 penetrating the interior of the socket 108 any further. This is because the head 102*b* is engaged with the shoulder 118*c* (FIG. 6). The remaining portion 120*a* of the threads 120 that were formed in the wall of the segment 118*b* by the screw 102 are visible in FIG. 8. However a portion 120*b* of the threads 120 has been stripped in the lowermost portion of the segment 118*b*. This area of the plastic sleeve 116 still maintains an interference fit with a portion of the male threaded segment 102*a* of the screw 102 that urges the screw 102 in an upwards direction when the screw 102 is turned counter-clockwise. This forces the threaded segment 102*a* of the screw 102 to engage with the undamaged remaining portion 120*a* of the female threads 120 in the sleeve 116 to allow normal operation of the screw 102. The longitudinal dimension of the lower segment 118*b* of the sleeve 116 is carefully selected relative to the longitudinal dimension of the unthreaded segment 102*d* of the screw 102. The portion 120*b* of the threads that is stripped out produces less downward force when the screw 102 is being turned in a clockwise direction than the stopping force produced when the head 102*b* meets the shoulder 118*c* otherwise the screw 102 will continue to drive down further.

Figure 9:
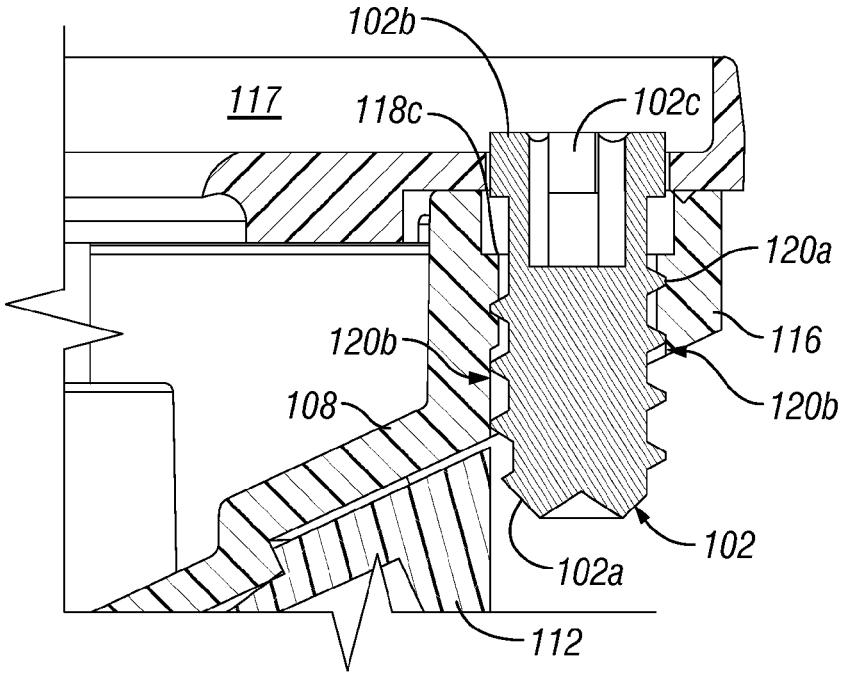

FIG. 9 illustrates the screw 102 backed out to a proper level to retain the nozzle 112 in position in the socket 108 after the screw 102 has been over-tightened. The screw 102 can still be further retracted to allow for removal and installation of a different nozzle in place of the nozzle 112 or to adjust the radius of the sprinkler. The portion 120*a* of the female threads formed in the upper portion of the lower segment 118*b* are still in tact and allow for vertical movement of the screw 102 when it is rotated in a counter-clockwise direction by the tool. The stripped-out portion 120*b* of the threads 120 still provide support around the threaded segment 102*a* of the screw 102 in the lower portion of the sleeve 116 so that the sleeve 116 can still retain the nozzle 112 and diffuse the stream of water if desired.

Figure 10:
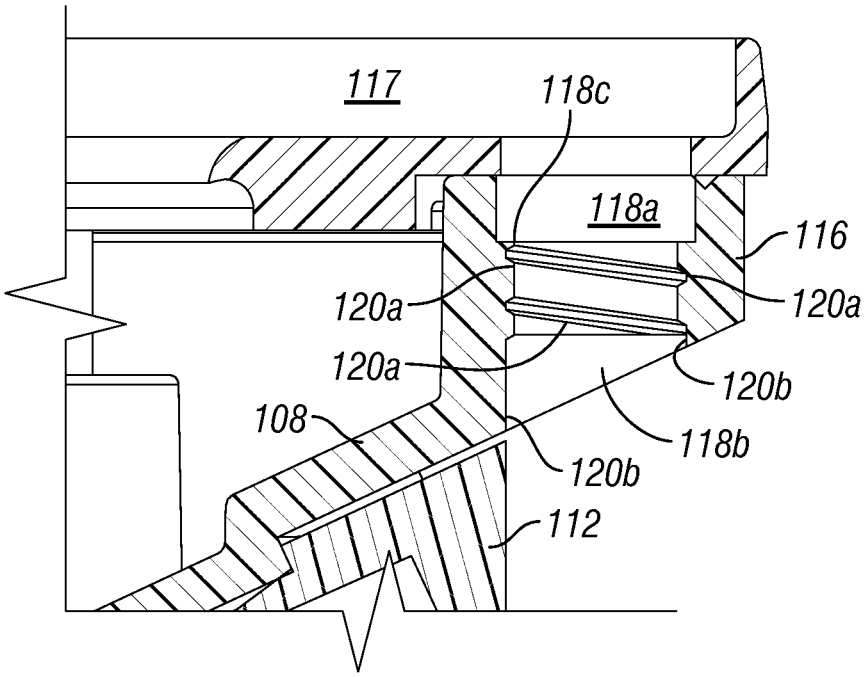
FIG. 10 is a view similar to FIG. 4 after the nozzle retention screw has been screwed into the sleeve in the nozzle turret, over-tightened, and then removed to illustrate the altered shape of the sleeve after a portion of its females has been stripped by over-tightening of the nozzle retention screw.

FIG. 10 illustrates the configuration of the bore 118 in the sleeve 116 of the nozzle turret 100 after the screw 102 has been completely removed. The portion 120*a* of the female threads 120 that remains still allows for proper functionality of the screw 102 when it is backed off and when it is reinstalled. The lower portion of the segment 118*b* of the bore 118 that was stripped now has a diameter that is approximately the same as the outer diameter of the male threaded segment 102*a* of the screw 102. The snug fit between the wall of the stripped portion of the segment 118*b* and the male threaded segment 102*a* of the screw still provides support for the screw 102 and helps provide rigidity sufficient for normal retention of the nozzle 112.

Thus I have described a novel nozzle turret 100 that has a captive nozzle retention screw 102. The nozzle retention screw 102 is captive in the sense that it remains in place in the sleeve 116 regardless of over-tightening and stripping of a portion of the threads in the bore 118 in the sleeve 116. The nozzle turret 100 can be easily incorporated into known rotor-type sprinklers of the type illustrated in the aforementioned U.S. Pat. No. 7,287,711. The nozzle turret 100 is mounted for rotation at an upper end of a riser. A gear train reduction is mounted in the riser and a turbine is coupled to the gear train reduction. A drive assembly in the riser couples the gear train reduction and the turret. The drive assembly can permit arc-adjustable oscillation of the nozzle turret 100, only full-circle rotation of the nozzle turret 100, or the ability to select between oscillation and full-circle rotation. The present invention solves a problem that has plagued the residential and commercial irrigation industry for decades. Heretofore, over-tightening of the nozzle retention screw 42 of the prior art nozzle turret 10 (FIG. 1) has occurred all too frequently, stripping all of the threads in the sleeve portion 44 and effectively destroying the ability of homeowners and landscape maintenance personnel to change out the nozzle 16 and/or adjust the radius of the sprinkler.

While I have described an embodiment of a nozzle turret in accordance with my invention, those skilled in the art will understand that it can be modified in both arrangement and detail. Therefore the protection afforded my invention should only be limited in accordance with the scope of the following claims.

I claim:

1. A nozzle turret for an irrigation sprinkler, comprising:

a body having a rotational axis and a nozzle socket having an insertion axis extending transverse to the rotational axis;

a nozzle removably received in the socket;

a sleeve opening on a top side of the body and defining a bore that communicates with the socket; and a nozzle retention screw with a shank having a lower male threaded segment screwed into the bore of the sleeve from the top side of the body, the shank extending into the socket a sufficient depth to retain the nozzle in the socket, the screw having a head that abuts an upper end of the sleeve when the screw is fully screwed in a downward direction into the sleeve, and the screw shank having an upper unthreaded segment with a predetermined longitudinal dimension selected relative to a longitudinal dimension of the bore whereby the screw can be unscrewed in an upward direction from the sleeve despite stripping of a segment of a female threaded portion of the bore.

2. The nozzle turret of claim 1 wherein the body is made of injection molded plastic and the screw is made of metal.

3. The nozzle turret of claim 2 wherein the female threaded portion of the bore is formed when the screw is screwed into the bore.

4. The nozzle turret of claim 1 wherein the bore has an upper larger diameter segment and a lower smaller diameter segment.

5. The nozzle turret of claim 4 wherein the upper larger diameter segment is size sized to receive the head.

6. The nozzle turret of claim 4 wherein the lower smaller diameter segment is dimensioned to provide an interference fit when the female threaded portion is stripped.

7. The nozzle turret of claim 1 wherein the shank of the screw has a longitudinal dimension sufficient so that the screw can be turned to move the shank to interrupt a stream of water ejected from the nozzle.

8. The nozzle turret of claim 1 wherein the nozzle has a U-shaped opening in the nozzle positioned to receive the shank of the screw for retaining the nozzle in position in the socket.

9. The nozzle turret of claim 1 wherein the socket has a dog-legged configuration.

10. The nozzle turret of claim 1 and further comprising an elastomeric cover overlying a top side of the body and having a cross-shaped slit aligned with the head of the screw for permitting a tool to engage the head of the screw through the covering.

11. An irrigation sprinkler, comprising:

a riser;

a nozzle turret mounted for rotation at an upper end of the riser; and the nozzle turret having a socket, a nozzle removably mounted in the socket, a sleeve that communicates with the socket, and screw means for screwing into the sleeve to retain the nozzle in the socket and unscrewing from the sleeve to allow removal of the nozzle despite stripping of a female threaded portion of the sleeve, wherein the screw means is a nozzle retention screw having a shank with a lower threaded segment and an upper unthreaded segment, and wherein the screw has a head that abuts an upper end of the sleeve when the screw is fully screwed in a downward direction into the sleeve.

12. The sprinkler of claim 11 wherein the sleeve has a bore with an upper larger diameter segment and a lower smaller diameter segment and a shoulder at a junction of the upper segment and the lower segment.

13. The sprinkler of claim 11 wherein the turret includes a body having a rotational axis and the nozzle socket has an insertion axis that extends transverse to the rotational axis.

14. The sprinkler of claim 11 wherein the female threaded portion of the sleeve is formed by the threads of the screw.

15. The sprinkler of claim 11 wherein the sleeve opens on a top side of the turret.

16. The sprinkler of claim 11 wherein the sleeve is made of plastic and the screw is made of metal.

17. The sprinkler of claim 11 wherein a longitudinal dimension of the unthreaded segment of the shank is less than a minimal longitudinal dimension of the sleeve.

18. An irrigation sprinkler, comprising:

a riser;

a nozzle turret mounted for rotation at an upper end of the riser; and the nozzle turret including a body having a rotational axis and a nozzle socket extending transverse to the rotational axis, a nozzle removably received in the socket, a sleeve opening on a top side of the body and defining a bore that communicates with the socket, and a nozzle retention screw with a shank having a lower male threaded segment screwed into the bore of the sleeve from the top side of the body, the shank extending into the socket a sufficient depth to retain the nozzle in the socket, the screw having a head that abuts an upper end of the sleeve when the screw is fully screwed downwardly in the sleeve by rotating the screw in a first direction, the screw shank having an upper unthreaded segment with a predetermined longitudinal dimension selected relative to a longitudinal dimension of the bore whereby the screw can continue to be rotated in the first direction after the head of the screw abuts the upper end of the sleeve and a remaining interference fit between the screw and the sleeve allowing the screw to thereafter be rotated in an opposite direction to move the screw upwardly in the sleeve.

* * * * *